United States Patent [19]

Nakajima et al.

[11] 4,222,777

[45] Sep. 16, 1980

[54] PROCESS FOR FORMING COLOR IMAGES

[75] Inventors: Yosuke Nakajima; Akira Ushimaru; Shinzo Kishimoto; Yoshio Seoka; Masayoshi Kawai; Naoyoshi Chino; Yoshiyuki Hoshi; Kazunori Hasebee, all of Saitama, Japan

[73] Assignee: Fuji Photo Film Co., Ltd., Minami-ashigara, Japan

[21] Appl. No.: 842,196

[22] Filed: Oct. 14, 1977

Related U.S. Application Data

[63] Continuation of Ser. No. 661,930, Feb. 21, 1976, abandoned.

[30] Foreign Application Priority Data

Feb. 28, 1975 [JP] Japan ..... 50-24796

[51] Int. Cl.[2] ..... G03C 7/00; G03C 5/38

[52] U.S. Cl. ..... 430/363; 430/380

[58] Field of Search ..... 96/55, 61 R, 56.6, 111

[56] References Cited

U.S. PATENT DOCUMENTS

| | | | |
|---|---|---|---|
| 2,515,122 | 7/1950 | Harsh et al. | 96/61 R |
| 2,614,927 | 10/1952 | Broughton et al. | 96/61 R |
| 3,114,833 | 12/1963 | Fine | 96/55 |
| 3,288,775 | 11/1966 | Anderau et al. | 96/111 |
| 3,325,287 | 6/1967 | Yamamoto et al. | 96/111 |
| 3,556,789 | 1/1971 | Johnston et al. | 96/61 R |
| 3,615,509 | 10/1971 | Klein et al. | 96/55 |
| 3,734,735 | 5/1973 | Boties | 96/55 |
| 3,769,014 | 10/1973 | Stewart et al. | 96/61 R |
| 3,905,821 | 9/1975 | Ohtani et al. | 96/111 |

*Primary Examiner*—Richard L. Schilling

*Attorney, Agent, or Firm*—Sughrue, Rothwell, Mion, Zinn and Macpeak

[57] ABSTRACT

A process for forming color images which comprises image-wise exposing a silver halide photographic material, subjecting the exposed photographic material to color development and then fixing the developed material with a fixing bath having a pH of at least 6, the process being free from a silver bleaching (elimination) step. The process is especially suitable for application to radiographic materials.

22 Claims, No Drawings

PROCESS FOR FORMING COLOR IMAGES

This is a continuation of application Ser. No. 661,930, filed Feb. 21, 1976 now abandoned.

BACKGROUND OF THE INVENTION

1. FIELD OF THE INVENTION

This invention relates to a process for forming a color image, more specifically, to a process for rapidly obtaining a color image of excellent quality by fixing with a bath having a pH of at least 6.

2. DESCRIPTION OF THE PRIOR ART

It is important in obtaining recorded information promptly to process photographic materials as rapidly as possible, and this is especially so in the case of radiographic materials. Automatic processors are known which attempt to process exposed radiographic materials within the shortest possible time by conducting a photographic material at a fixed rate from one processing unit to another (for example, see U.S. Pat. No. 3,025,779). A method is also known which comprises processing an exposed black-and-white radiographic material by means of such an automatic processor within 3.5 minutes to thereby form an image (for example, see U.S. Pat. No. 3,545,971).

On the other hand, it is known to form color images by irradiating a color photographic material with radioactive rays. According to this technique, a color radiographic image is formed, optionally together with a silver image, on a radiographic material containing at least one color coupler capable of forming a color image upon coupling with an oxidized aromatic primary amine developing agent. When the radiographic material does not contain a coupler, development with a color developer containing a coupler likewise affords a color image together with a silver image. As disclosed, for example, in U.S. Pat. Nos. 3,114,833, 2,644,096, 2,931,904, 3,493,748, 3,695,882, 2,994,610 and 3,734,735, and Japanese Patent Publication (OPI) No. 37,539/72, these color radiographic materials have advantages over black-and-white radiographic materials in that the amount of information retrieval possible is increased, the exposure latitude is high, the amount of information carried is high because of good granularity, and the silver halide content can be maintained low.

In the present invention, the term "radiographic" is not especially limited, and includes X-rays, $\alpha$-rays, $\beta$-rays, $\gamma$-rays, and the like; for most purposes, on a commercial scale, radiographic materials are generally exposed to X-rays.

Quinoneimine color images formed by the coupling of oxidized aromatic primary amine developing agents with phenol- or $\alpha$-naphthol-type color couplers generally decrease in color density in an acidic fixing bath. Since a partially faded color image regains its color upon oxidation, this decrease in color density does not so much pose a problem where there is a silver bleaching step, for example, in the processing of general color photographic materials. However, the method of forming radiographic color images in which color images are obtained together with a silver image through a series of rapid color development, fixing, rinsing, and drying steps does not include a silver bleaching step because there is no need to eliminate silver and it is desired to obtain the images within as short a period as possible. Accordingly, the decrease of color density in the fixing step is a great defect of this method.

SUMMARY OF THE INVENTION

It is one object of this invention to provide a process for rapidly forming a color image having high contrast and high density using a radiographic material.

Another object of this invention is to obtain a color image having good contrast, sensitivity and density.

According to this invention, there is provided a process for forming color images which comprises imagewise exposing a silver halide photographic material, subjecting the exposed material to color development and fixing the developed material with a fixing bath having a pH of at least 6, the process being free from a silver elimination step.

DETAILED DESCRIPTION OF PREFERRED EMBODIMENTS

As will be appreciated by one skilled in the art, in the conventional processing of color film distinct dye images are obtained by a silver bleaching step, but one primary object of the present invention is to provide distinct dye and silver images of high color density where a silver bleaching step is not required. In the case of the present invention, high image density is obtained by fixing at high pH values, thereby permitting one to eliminate a silver bleaching step, a substantial benefit to the art.

The photographic material used in this invention contains a silver halide emulsion which is prepared in a conventional manner by mixing a solution of a water soluble silver salt (e.g., silver nitrate) with a solution of a water soluble halogen salt (e.g., potassium bromide) in the presence of a solution of a water soluble polymer such as gelatin. Silver chloride, silver bromide, and mixed silver halides such as silver chlorobromide or silver iodobromide can, for example, be used as the silver halide. Silver iodobromide containing not more than about 10 mol% of silver iodide is especially preferred. The silver halide grains may be in the form of cubic crystals, octahedral crystals or mixtures thereof. It is not particularly necessary to adjust the grain sizes to a uniform value. These silver halide grains can be prepared by conventional methods. Of course, it is also advantageous to employ the so-called single or double jet method or the controlled double jet method. It is also possible to mix at least two silver halide emulsions which have been separately prepared.

The crystal structure of the silver halide grains may be uniform throughout, or a layered structure in which the interior core differs from the outside shell in crystal structure, or a "conversion-type" structure as disclosed in British Pat. No. 635,841 and U.S. Pat. No. 3,622,318 can be used. Furthermore, the silver halide grains may be of a type in which a latent image is formed mainly on their surface or of a type in which it is formed mainly in their interior. These photographic emulsions can be prepared by various methods such as the ammonia method, neutral method or acidic method which are described in C. E. K. Mees, *The Theory of the Photographic Process,* Macmillan Pub. Co., and Glafikides, *Chimie Photographique,* Paul Montel (1957).

The silver halide grains so prepared are then rinsed with water in order to remove by-product water soluble salts (for example, potassium nitrate when silver bromide is prepared from silver nitrate and potassium bromide), and then heated in the presence of a chemical sensitizer such as sodium thiosulfate, N,N,N'-trimethyl thiourea, a monovalent gold-thiocyanate complex salt or thiosulfate complex salt, stannous chloride, or hexamethylene tetramine to increase their sensitivity without increasing the size of the grains. The general procedures and conditions for performing these steps are described in the above cited publications.

Examples of hydrophilic colloids used as a vehicle for silver halide include all conventionally known hydrophilic colloids as are used in the photographic arts, and the exact hydrophilic colloid or colloid selected is not overly important; examples of such include gelatin, colloidal albumin, casein, cellulose derivatives such as carboxymethyl cellulose or hydroxyethyl cellulose, agar, sodium alginate, saccharide derivatives such as starch derivatives such as acetyl starch, and synthetic hydrophilic colloids such as polyvinyl alcohol, poly-N-vinyl pyrrolidone, polyacrylic acid copolymers, polyacrylamide, and derivatives such as acrylamide copolymers or partially hydrolyzed products thereof. If desired, mixtures of two or more of these colloids which are miscible can be used. Of these, gelatin is most generally used. The gelatin can, either partly or wholly, be replaced by a synthetic polymer as above described. Furthermore, there can be used gelatin derivatives obtained by treating the functional groups present in the molecules of gelatin, such as amino, imino, hydroxy and carboxyl groups, with a reagent containing one group capable of reacting with the functional groups, or graft copolymers obtained by bonding the molecular chains of another polymeric substance to gelatin.

Examples of reagents used for preparing gelatin derivatives are the isocyanates, acid chlorides and acid anhydrides disclosed in U.S. Pat. No. 2,614,928, the acid anhydrides disclosed in U.S. Pat. No. 3,118,766, the bromoacetic acids disclosed in Japanese Patent Publication No. 5,514/64, the phenyl glycidyl ethers disclosed in Japanese Patent Publication No. 26,845/67, the vinylsulfone compounds disclosed in U.S. Pat. No. 3,132,945, the N-allyl vinylsulfonamides disclosed in British Pat. No. 861,414, the acrylonitriles disclosed in U.S. Pat. No. 2,594,293, the maleimide compounds disclosed in U.S. Pat. No. 3,186,846, the polyalkylene oxides disclosed in U.S. Pat. No. 3,312,553, the epoxy compounds disclosed in Japanese Patent Publication No. 26,845/67, the acid esters disclosed in U.S. Pat. No. 2,763,639, and the alkane sultones disclosed in British Pat. No. 1,033,189.

Polymers to be grafted onto gelatin are described, for example, in U.S. Pat. Nos. 2,763,625, 2,831,767 and 2,956,884, *Polymer Letters* 5, 595 (1967), *Photo Sci. Eng.* 9, 148 (1965), and *J. Polymer Sci. A*-1, 9, 3199 (1971), and a wide range of polymers or copolymers of vinyl monomers, such as acrylic acid or methacrylic acid, esters of acrylic or methacrylic acid, derivatives of amides and nitriles such as acrylamide and acrylonitrile, or styrene, can be used. Hydrophilic vinyl polymers having good compatibility with gelatin, such as polymers or copolymers of acrylic acid, acrylamide, methacrylamide, hydroxyalkyl acrylates, or hydroxyalkyl methacrylates, are especially preferred.

It is most preferred that silver halide be utilized in the elements processed in accordance with the present invention in an amount of at most about 15 g $Ag/m^2$ of the support, even more preferably less than about 7 g $Ag/m^2$, same basis.

The above described silver halide emulsion can also be chemically sensitized by conventional methods. Examples of chemical sensitizers for use in this end include the gold compounds such as chloroaurates or gold chloride as disclosed in U.S. Pat. Nos. 2,399,083, 2,540,085, 2,597,856 and 2,597,915, the salts of noble metals such as platinum, palladium, iridium, rhodium or ruthenium as disclosed in U.S. Pat. Nos. 2,448,060, 2,540,086, 2,566,245, and 2,598,079, the sulfur compounds capable of forming silver sulfide by reaction with silver salts as disclosed in U.S. Pat. Nos. 1,574,944, 2,410,689, 3,189,458 and 3,501,313, and the stannous salts, amines and other reducible substances as disclosed in U.S. Pat. Nos. 2,487,850, 2,518,698, 2,521,925, 2,521,926, 2,694,637, 2,983,610 and 3,201,254.

Stabilizers, antifoggants, surface active agents, hardeners and development accelerators can be added to the above described photographic emulsions, if desired. Various compounds can be added in order to prevent sensitivity reduction or fog during the manufacture, storage or processing of the photographic materials. Many examples of these compounds are well known such as 4-hydroxy-6-methyl-1,3,3a,7-tetrazaindene, 3-methyl-benzothiazole, 1-phenyl-5-mercaptotetrazole, dihydroxy benzene, dihydroxy naphthol and many other heterocyclic compounds, mercury-containing compounds, mercapto compounds, metal salts, and phenols. Specific examples of useful compounds are described in C. E. K. Mees, *The Theory of the Photographic Process,* 3rd Edition (1966), citing original literature references, and in the following patents: U.S. Pat. Nos. 1,758,576, 2,110,178, 2,131,038, 2,173,628, 2,697,040, 2,304,962, 2,324,123, 2,394,198, 2,444,605 to 2,444,608, 2,566,245, 2,694,716, 2,697,099, 2,708,162, 2,728,663 to 2,728,665, 2,476,536, 2,824,001, 2,843,491, 2,886,437, 3,052,544, 3,137,577, 3,220,839, 3,226,231, 3,236,652, 3,251,691, 3,252,799, 3,281,135, 3,326,681, 3,420,668 and 3,622,339, and British Pat. Nos. 893,428, 403,789, 1,173,609 and 1,200,188.

The surface active agents may be added alone or as admixtures of two or more thereof for the purpose of, for example, acting as a coating aid, emulsification and dispersion, sensitization, improvement of photographic properties, static prevention and adhesion prevention. These surface active agents are classified into natural surfactants such as saponin, nonionic surfactants such as alkylene oxide, glycerin and glycidol type compounds, cationic surfactants such as higher alkylamines, quaternary ammonium salts, pyridine and other heterocyclic compounds, phosphoniums and sulfoniums, anionic surfactants such as compounds containing an acidic group such as a carboxylic acid, sulfonic acid, phosphoric acid, sulfate ester and phosphate ester group, and amphoteric surfactants such as amino acids, aminosulfonic acids, and sulfate or phosphate esters of aminoalcohols.

Examples of useful surface active agents are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Patent Application (OLS) No. 1,942,665, British Pat. Nos. 1,077,317 and 1,198,450, *Synthesis and Application of Surface Active Agents* (Japanese language publication by Ryohei Oda et al., 1964, Maki Shoten Co., Ltd.), A. W. Perry, *Surface Active Agents* (1958, Interscience Publication Incorporated), and J. P. Sisley, *Encyclopedia of Surface Active Agents, Vol.* 2, 1964, Chemical Publishing Company.

The development accelerators include pyrazolidone compounds, quaternary ammonium salts and polyethylene glycols. Of these, the quaternary ammonium salts and polyethylene glycols are especially effective when processing the photographic material with a fixing bath having a pH of at least 6.

The photographic emulsion can be hardened by a conventional method, if desired. Examples of useful hardeners are aldehyde compounds such as formaldehyde and glutaraldehyde; ketone compounds such as diacetyl and cyclopentanedione; compounds containing a reactive halogen such as bis(2-chloroethylurea), 2-hydroxy-4,6-dichloro-1,3,5-triazine, and the compounds shown in U.S. Pat. Nos. 3,288,775 and 2,732,303 and British Pat. Nos. 974,723 and 1,167,207; compounds containing reactive olefins such as divinylsulfone, 5-acetyl-1,3-diacryloylhexahydro-1,3,5-triazine and the compounds disclosed in U.S. Pat. Nos. 3,635,718 and 3,232,763 and British Pat. No. 994,869; N-methylol compounds such as N-hydroxymethyl phthalamide and the compounds disclosed in U.S. Pat. Nos. 2,732,316 and 2,586,168; isocyanates such as those disclosed in U.S. Pat. No. 3,103,437; aziridine compounds such as those disclosed in U.S. Pat. Nos. 3,017,280 and 2,983,611; acid derivatives such as those described in U.S. Pat. Nos. 2,725,294 and 2,725,295; carbodiimide type compounds such as those disclosed in U.S. Pat. No. 3,100,704; epoxy compounds such as those disclosed in U.S. Pat. No. 3,091,537; isoxazole type compounds such as those disclosed in U.S. Pat. Nos. 3,321,313 and 3,543,292; halogenocarboxyaldehydes such as mucochloric acid; dioxane derivatives such as dihydroxydioxane or dichlorodioxane; and inorganic hardeners such as chrome alum and zirconium sulfate.

Instead of the above hardeners, precursors thereof such as alkali metal bisulfite/aldehyde adducts, methylol derivatives of hydantoin, and primary aliphatic nitroalcohols can also be used.

The above hardeners can be used for fixing at high pH values in accordance with this invention. In particular, when the photographic material is processed in an automatic processor, damage caused by rollers and the rate of the finished photographic material are affected by the degree of hardening, and when the developer and fixing bath do not contain a hardener, it is necessary to increase the degree of hardening of the photographic material. The degree of hardening is preferably such that the film thickness at the end of the rinsing step is not more than 8 times the thickness of the dry film before processing.

The above hardeners are used in conventional amounts, for example, about 0.003 to about 3 g/g of hydrophilic colloid, most typically gelatin.

The photographic emulsion so prepared is coated on a planar material which does not undergo substantial dimensional changes during processing, for example, a hard support such as glass, metal or porcelain, or a flexible support, chosen according to the end use.

Typical flexible supports include, for example, cellulose nitrate films, cellulose acetate films, cellulose acetate butyrate films, cellulose acetate propionate films, polystyrene films, polyethylene terephthalate films, polycarbonate films, laminates of such films, thin glass films, and paper as are usually employed for photographic materials. Baryta paper, papers on which an α-olefin polymer is coated or laminated, especially a polymer of an α-olefin containing 2 to 10 carbon atoms such as polyethylene, polypropylene or ethylene/butene copolymer, and plastic films whose surfaces have been roughened to improve their adhesion to other polymeric substances and increase their printability (such as those described in Japanese Patent Publication No. 19,068/72) also give good results as supports.

These supports can be either transparent or non-transparent according to the intended use. Transparent supports may either be colorless or may be colored by the addition of a dye or pigment. Coloration has been a conventional practice with X-ray films, for example, and is known from *J.S.M.P.T.E.* 67, 296 (1958). For example, the supports can be colored yellow or blue in order to increase the quality of the images.

For example, in the case of the most common polyester supports, typical blue coloring agents include an anthraquinone dye, indanthrone dye, indigoid dye, phthalocyanine dye or azo dye, especially an anthraquinone dye. Examples of the anthraquinone dye are 1,4-dimesidinoanthraquinone, 1,4-bis-(2′,6′-diethylanilino)anthraquinone, 1-(2′,6′-dimethylanilino)-4,5,8-trihydroxyanthraquinone, 1-(2′,4′,6′-trimethylanilino)-4,5,8-trihydroxyanthraquinone, 1-(2′,6′-diethylanilino)-4,5,8-trihydroxyanthraquinone, 1-(2′-methyl-6′-ethylanilino)-4,5,8-trihydroxyanthraquinone, 1-amino-4-benzoylaminoanthraquinone, 1,4,5,8-tetra-(o-carboxyanilino)anthraquione, 1-methylamino-4-(o-carboxyanilino)anthraquinone, 1,5-bis-(o-carboxyphenylthio)anthraquinone, 1,4-di-p-butylanilino-5′,8′-dihydroxyanthraquinone, and 1,4,5,8-tetrahydroxyanthraquinone. These anthraquinones dyes are described, for example, in U.S. Pat. Nos. 2,571,319, 3,372,138, 3,488,195, 3,359,230, 3,413,257, 3,530,132 and 3,487,041, and in British Pat. No. 1,196,707.

Useful indanthrone dyes include, for example, CI (color index) 68420; useful indigoid dyes include, for example, CI 7335 and CI 73360; useful phthalocyanine dyes include, for example, CI 74350; and useful azo dyes include, for example, CI 11215, CI 26080 and CI 26105.

Non-transparent supports include inherently non-transparent supports such as paper, supports obtained by adding a dye or a pigment such as titanium oxide to transparent films, plastic films surface treated by a method as disclosed, for example, in Japanese Patent Publication No. 19,068/72, and papers and plastic films rendered completely light shielding by adding carbon black, dyes or the like thereto.

Where adhesion between the support and a photographic emulsion layer is insufficient, it has been the practice to provide an adhesive undercoat layer on either one of these. In order to further increase adhesiveness, the surface of the support may be pre-treated by, for example, corona discharge, ultraviolet irradiation or flame treatment.

Color photographic images obtained by this invention are preferably cyan color images or blue color images having their main absorption in the red region (about 600 to about 700 mμ) and the longer wavelength region (about 550 to about 600 mμ) of the green region of the visible spectrum.

In order to achieve this purpose, phenol type or α-naphthol type color couplers which form quinoneimide dyes having a maximum absorption in the spectral wavelength region of about 550 to about 700 mμ when the exposed silver halide is developed with an aromatic primary amine developer are especially preferred as color couplers. Couplers having such characteristics are classified into the following three types.

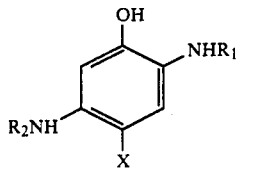

(I)

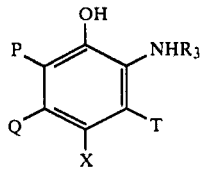

(II)

or

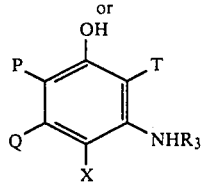

(II)

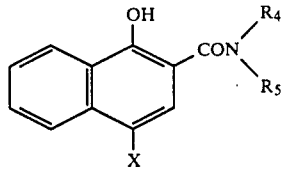

(III)

In these formulae, $R_1$, $R_2$ and $R_3$ (in the following, where a carbon atom range is given, if substituent(s) is present, the substituent(s) is included in the carbon atom range: further, where a group may contain two moieties, for example, an acyl group derived from an aryloxy substituted aliphatic carboxylic acid, and it is indicated that this group can be substituted, the substituent can occur on, for example, either the aryloxy or the aliphatic carboxylic acid moiety) represent an acyl group derived from substituted or unsubstituted aliphatic carboxylic acids containing 2 to 25 carbon atoms, an acyl group derived from substituted or unsubstituted aromatic carboxylic acids containing 7 to 30 carbon atoms, an acyl group derived from substituted or unsubstituted heterocyclic carboxylic acids containing 1 to 5 nitrogen, oxygen or sulfur atoms either alone or in combination and 2 to 25 carbon atoms such as a 2-furoyl or 2-thienoyl group, an acyl group derived from substituted or unsubstituted aliphatic sulfonic acids containing 1 to 25 carbon atoms, an acyl group derived from substituted or unsubstituted aromatic sulfonic acids containing 6 to 30 carbon atoms, a sulfonylthienyl group, or an acyl group derived from aryloxy substituted aliphatic carboxylic acids containing 7 to 30 carbon atoms (where the aryloxy group preferably contains 12 to 20 carbon atoms) which can be substituted or unsubstituted; $R_{14}$ and $R_5$ represent a hydrogen atom, a substituted or unsubstituted aryl group containing 6 to 30 carbon atoms, or a substituted or unsubstituted alkyl group containing 1 to 25 carbon atoms; P, Q and T represent a hydrogen atom, a halogen atom or a substituted or unsubstituted alkyl group containing 1 to 10 carbon atoms; and X represents a substituent which can be split off upon coupling with a developing agent, for example, a hydrogen atom or a halogen atom, or a group derived from a developing inhibitor or a dyestuff moiety such as azo, azomethine, indoaniline, indophenol or anthraquinone as shown in Japanese Patent Publications (OPI) Nos. 2,328/72 and 3,480/72 and in Japanese Pat. Nos. 15,471/70 and 8,750/72.

In the preceding paragraph where the term "substituted" is used, this refers to substituents which are well known in the art, as discussed in the hereinafter cited patents, such as furyl, aryloxy, alkoxy, carboxy, acyloxy, hydroxy, halogen, acylamino, aralkyl, and the like.

The phenol type ortho-meta-diamide couplers of formula (I) are described, for example, in U.S. Pat. Nos. 2,772,162, 3,222,176 and 3,758,308. The phenol type ortho- or meta-amide couplers of formula (II) are described, for example, in U.S. Pat. No. 3,737,318 and Japanese Patent Publication (OPI) No. 4,480/72. The α-naphthol type couplers of formula (III) are described, for example, in U.S. Pat. Nos. 3,591,383 and 3,476,563 and in British Pat. Nos. 1,201,110, 1,038,331, 727,693 and 747,628.

These couplers can be divided into oleophilic couplers used by an oil dissolving-dispersing method and hydrophilic couplers used by a water dissolving-dispersing method. According to the oil dissolving-dispersing method, an oleophilic coupler is dissolved in an organic solvent, and the resulting solution is directly dispersed as fine colloidal particles in a photographic emulsion or in a gelatin layer, or the coupler solution is first dispersed in an aqueous medium, and then added to a photographic emulsion or an aqueous solution of gelatin. The oleophilic coupler forms fine oil droplets together with the dispersing organic solvent. It is necessary to minimize the particle size of these oil droplets, namely to maximize their surface areas. Chemicals required for oil dissolving-dispersing and chemicals in the dispersions are, for example, surface active agents, gelatin, organic solvents, and additives. Specific examples of anionic surface active agents are alkyl sulfonic acid salts, alkylbenzenesulfonic acid salts, alkyl sulfate ester salts, alkylcarboxylate salts, GARDINOL WA (trademark for sulfated coconut fatty alcohol, a product of E.I. Du Pont de Nemours & Co., see U.S. Pat. No. 2,332,027), triisopropylnaphthalenesulfuric acid salt (see U.S. Pat. No. 2,332,027), Alkanol B (sodium triisopropylnaphthalene sulfonate; see U.S. Pat. No. 2,801,170), and water soluble couplers containing both a sulfonic or carboxyl group and a long-chain aliphatic group (see Japanese Pat. No. 428,191).

The gelatin can be selected from any gelatin as is conventionally used in the art such as acid processed gelatin, lime processed gelatin and enzyme processed gelatin. Gelatins having an average molecular weight of at least 30,000 are suitable for fine emulsification. Furthermore, the gelatin may be modified with a reagent such as an amylating agent.

Prior to an emulsifying, an oil soluble coupler must be heat-melted or dissolved in an organic solvent to render it liquid. Couplers which can be directly emulsified by melting are limited to those having a melting point of at least about 90° C.

Solvents used for finely dispersing an oil soluble coupler in an aqueous medium are advantageously those which are insoluble or substancially insoluble in water and have a boiling point of at least 190° C. Specific examples of organic solvents of this kind include carboxylic acid esters, tricresyl phosphate, phosphoric acid esters, tri-n-butyl phosphate, diisooctyl phthalate, triisooctyl phosphate, dimethoxyethyl phthalate, N,N-diethylcaprylamide, di-n-butyl adipate, N,N-dimethylpalmitamide, tri-n-butyl citrate, n-butyl-m-pentadecyl phenyl ether, butyl laurate, ethyl-2,4-tert-butyl phenyl ether, di-n-butyl sebacate, and chlorinated paraffins.

Sometimes, the use of low-boiling point solvents or water soluble high boiling point solvents in combination with the above solvents is advantageous in order to dissolve the couplers. Specific examples of such high-boiling point solvents are propylene carbonate, cyclohexanone, ethyl acetate, dimethyl formamide, butyl acetate, diethyl sulfoxide, ethyl propionate, methyl cellosolve, butyl alcohol, and tetrahydrofuran.

If desired, the organic solvent dispersion may contain one or more ultraviolet absorbants, antioxidants, antifoggants, developing agents, developer aids and development accelerators in addition to the oil soluble couplers.

Suitable emulsifying devices are those which exert a high shearing force on the solution to be treated or impart ultrasonic energy of high intensity thereto. In particular, a colloid mill, a homogenizer, a capillary type emulsifying device, an electromagnetic strain type ultrasonic generator, and an emulsifying device having a Paulman whistle give good results.

For example, there is the following method for dispersing water soluble couplers. A coupler containing at least one ballasting group, for example, a long-chain aliphatic group such as an alkyl or alkylene group containing 5 to 20 carbon atoms, and at least one salt forming group such as a carboxyl or sulfo group, can be mixed as an aqueous solution with an aqueous hydrophilic colloid composition in the form of an alkali metal salt thereof.

The above coupler is dissolved in an alkali metal hydroxide solution of water or a mixture of water and an alcohol such as methanol or ethanol, for example, an aqueous sodium hydroxide or alcoholic potassium hydroxide solution. The resulting solution is directly added to a photographic emulsion. Alternatively, it is first mixed with a hydrophilic colloid composition, for example, an aqueous solution of a hydrophilic colloid or a molten gel containing a hydrophilic colloid, and the solution obtained is added to the photographic emulsion.

Most sensitized fluorescent screens used together with radiographic materials for therapeutic purposes comprise calcium tungstate, lead/barium sulfate, or calcium tungstate/barium tungstate as a fluorescent material. Sensitized screens containing a fluorescent substance which has more than half of its spectral emission at a wavelength greater than about 410 nm and a main fluorescent radiation maximum in the green region of the spectrum can also be advantageously used.

Green light emitting sensitized screens are preferably those containing fluorescent substance such as rare earth elements having an atomic number of 39 or 57 to 71 (e.g., yttrium, gadolinium, lanthanum, or cerium), as disclosed in Japanese Patent Publications (OPI) Nos. 55,730/73, 52,990/74 and 63,424/74.

With a combination of a radiographic emulsion characterized by being spectrally sensitized to a wavelength region of about 480 to about 600 nm and such a green light emitting sensitized screen, the radiographer can use low X-ray doses.

In a radiograhic combination consisting of X-rays, a sensitized screen and a radiographic material, the screen can be provided separately from the silver halide radiographic material, or the screen and the silver halide emulsion layer can be provided on the same support. The silver halide emulsion can be formed on one or both surfaces of a support.

When the green light emitting sensitized screen is used, the silver halide emulsion for radiographic material is spectrally sensitized to a wavelength region of about 480 to about 600 nm. The spectral sensitization maximum is preferably between 520 nm and 560 nm.

The emulsion can be spectrally sensitized or supersensitized with cyanine dyes such as cyanine, merocyanine or carbocyanine either alone or in combination, or with a combination of such a cyanine dye and a styryl dye. Techniques for such color sensitization have long been known, and suitable methods for this purpose are described in U.S. Pat. Nos. 2,688,545, 2,912,329, 3,397,060, 3,615,635 and 3,628,964, British Pat. Nos. 1,195,302, 1,242,588 and 1,293,862, German Patent Applications (OLS) Nos. 2,030,326 and 2,121,780, and Japanese Patent Publications Nos. 4,936/68 and 14,630/69. Such a dye is used in an amount of about 10 to about 3,000 mg, preferably 20 to 1,000 mg, per mol of the silver halide.

Suitable spectrally sensitizing dyes for silver halide to be used in combination with a screen emitting light in a wavelength region of about 480 to about 570 nm are described in Japanese Patent Publication No. 14,030/69 and in Japanese Patent Publications (OPI) Nos. 33,626/72 and 59,828/73.

When the emulsion is to be developed under ordinary darkroom conditions, i.e., under a red safety lamp, the spectral sensitization of the silver halide emulsion should be performed so that its sensitivity to darkroom illumination is maintained as low as possible. It is preferred also to add a selectively acting sensitizing dye to the emulsion in order to reduce the sensitivity to darkroom illumination.

The individual layers of the photographic material can be coated by various conventional coating methods such as dip coating, air knife coating, curtain coating, or extrusion coating using a hopper of the type as described in U.S. Pat. No. 2,681,294. If desired, two or more layers can be coated simultaneously by methods as described, for example, in U.S. Pat. Nos. 2,761,791, 3,508,947, 2,941,898 and 3,526,528.

The color developer used in the present invention is an alkaline aqueous solution containing a color developing agent, which, upon developing the exposed silver halide, yields an oxidation product of the color developing agent in an image-wise manner in the exposed areas, which oxidation product then couples with a coupler to form a color image in accordance with the silver image pattern in exposed areas.

A color developer always contains a color developing agent, and also generally contains an antioxidant, an antifoggant, an alkali buffer, a metal ion shielding agent such as chelating agent, a development accelerator and a developer aid.

The color developing agent includes known aromatic primary amines such as aminophenols and phenylene diamines, with p-phenylene diamines in general being preferred. Examples of the aminophenols are p-aminophenol, 2,6-dichloro-4-aminophenol, 2-bromo-4-aminophenol, 2-phenyl-4-aminophenol, 2-methyl-4-aminophenol, and 2,6-dimethoxy-4-aminophenol. Examples of the phenylenediamines are unsubstituted p-phenylene diamine, o-phenylene diamine, phenylene diamines whose one amino group is substituted with 1 or 2 groups having an ether linkage, ester linkage, amide linkage, etc., such as an alkyl, hydroxyalkyl, carboxyalkyl, acyloxyalkyl, alkoxycarbonyl, alkyloxyalkyl, alkanesulfonamidealkyl, cycloalkyl or halogenoalkyl group or whose one amino group forms a part of a 5- or 6-membered saturated or unsaturated ring such as a piperidine, piperazine, pyrrolidine, morpholine, dihydroindole, tetrahydroquinone or tetrahydroisoquinoline group. Specific examples include N,N-dimethyl p-phenylenediamine, N,N-diethyl p-phenylenediamine, 4-(N-ethyl-N-β-hydroxyethyl)aminoaniline, 4-(N-ethyl-N-β-hydroxyethyl)-2-methylaniline, 4-(N-ethyl-N-β-methylsulfonamideethyl)amino-2-methylaniline, 4-(N,N-diethyl)amino-2-methylaniline, N,N-diethylamino-2-ethoxyaniline and 2,3-dihydro-5-amino-N-methylsukfonamideethylindole.

Examples of the antioxidant are the alkali metal sulfites and the hydroxylamines described in U.S. Pat. No. 2,286,662. Examples of the antifoggant are alkali metal bromides, alkali metal iodides and the nitrobenzimidazoles described in U.S. Pat. Nos. 2,496,940 and 2,656,271, mercaptobenzimidazole, 5-methylbenzotriazole and 1-phenyl-5-mercaptotetrazole. The alkali buffer for pH adjustment includes, for example, hydroxides, carbonates, phosphates and borates of alkali metals or ammonium, and ethylenediaminetetraacetic acid (EDTA). The metal ion shielding agent is, for example, sodium hexametaphosphate.

The auxiliary developing agents for developing aids that can be used are, for example, those described in L.F.A. Mason, *The Journal of Photographic Science,* Vol. 11, pp. 136 to 139 (1963), and G. F. van Veelen, *The Journal of Photographic Science,* Vol. 20, pp. 94 to 106 (1972), for example, pyrazolidones, pyrazolines, aminophenols, substituted phenylenediamines, substituted hydroquinones, Weitz radicals, and oxidation-reduction indicators.

Examples of the developing accelerators are the various pyridinium compounds or cationic compounds described, for example, in U.S. Pat. Nos. 2,648,604 and 3,671,247, potassium nitrate, sodium nitrate, the polyethylene glycol condensation products or the derivatives thereof described, for example, in U.S. Pat. Nos. 2,533,990, 2,577,127 and 2,950,970, nonionic compounds such as polythioethers typified by the compounds disclosed, for example, in British Pat. Nos. 1,020,033 and 1,020,032, polymer compounds containing a sulfite ester typified by the compounds disclosed in U.S. Pat. No. 3,068,097, organic amines such as pyridine or ethanolamine, benzyl alcohol, and hydrazines.

If desired, color couplers, competitive couplers, thickeners, and fade inhibitors can also be added.

The pH of the developer is usually maintained alkaline at about 9.0 to about 13.0 from the standpoint of the dissociation constant of the coupler and the degree of activity of the developing agent, etc.

Such factors are described in detail in C.E.K. Mees, *The Theory of the Photographic Process,* pp. 278–311 (Macmillan Company, New York, 1966).

The process of the present invention can be applied to a color development process free from a silver eliminating step, and it is important that after the color development the developed material be fixed with a fixing bath having a pH of at least 6, preferably at least 6.5.

Examples of the fixing agent used for the fixing bath are sodium thiosulfate, ammonium thiosulfate, potassium cyanide, ammonium thiocyanide, thiourea and sodium sulfite. Of these, sodium thiosulfate is preferred, most especially if used at a pH of 6 to about 11.

The amount of the fixing agent can be changed according to the characteristics thereof such as the stability, activity, speed and the like. For example, sodium thiosulfate is used in an amount of about 50 to about 400 g/l, preferably 100 to 200 g/l. One skilled in the art will easily be able to select the optimum fixing agent amount. Stabilizers for the fixing bath are, for example, sodium sulfite and potassium metabisulfite, the former being generally preferred. The stability of the fixing bath becomes better with increasing amounts of stabilizer, but the amount of the stabilizer is properly chosen within the range which is effective for practical purposes. For example, using sodium sulfite, from about 1 to about 50 g/l, more commonly 1 to 30 g/l, is very effective.

In fixing and hardening at low pH values, alum (potassium alum) is, for example, used, but it makes the recovery of silver from the used processing liquor extremely difficult. Fixing at high pH values in accordance with this invention has the advantage that sufficient effects can be exhibited using an organic hardener such as aldehyde and triazine compounds. Most preferred hardeners include hydroxydichlorotriazine sodium salt and mucochloric acid. Furthermore, in fixing at a high pH, various organic acids such as tartaric acid, citric acid, lactic acid, glacial acetic acid or boric acid are used as stabilizers. Of these, boric acid and glacial acetic acid are especially preferred.

Various salts can be used as a pH buffer. Generally, acetates and borates such as sodium acetate and sodium borate are used at a low pH to about neutral pH values, and carbonates such as sodium carbonate in the high pH region. In order to promote the development stopping effect of the fixing bath having a pH of at least 6, various development inhibitors such as mercapto compounds, benzotriazole, 5-nitrobenzimidazole, 5-nitroindazole or potassium bromide, a scavenging agent for an oxidation product of the development agent such as H acid, and antioxidants used in color developers may be used. Furthermore, it is possible to add an ammonium salt such as ammonium chloride as a fixing accelerator.

In accordance with the present invention, it is preferred that the pH of the fixing bath be at most about pH 12, and most preferably the pH of the fixing bath is maintained at less than 10.5, in general.

In both development and fixing in accordance with this invention, the processing temperature is about 20° to about 60° C., preferably 30° to 40° C.

The advantages obtained by the present invention are as follows:

(1) The density, sensitivity and contrast of the color image are improved to provide good color X-ray images. Since the image density is greatly increased, the amount of silver halide can be reduced.

(2) There is no adverse effect on the finished images due to a reduction in color density in the fixing treatment, and, therefore, the non uniformity of the quality of the finished image is avoided.

(3) The stability of the color images with the passage of time after processing is improved.

(4) Since Al alum is not used as a hardener, the fixing bath can be of a simple formulation and is inexpensive. Furthermore, silver can be easily recovered from the used fixing bath.

The following Examples are given to facilitate an understanding of the present invention.

EXAMPLE 1

1,100 g of a high speed silver bromoiodide emulsion (AgI, 5.5 mol%) obtained by reacting 50 g of gelatin and 120 g of silver nitrate with an equimolar amount of an alkali metal halide was mixed with 1,000 g of an emulsion containing 67 g of a coupler of the following formula:

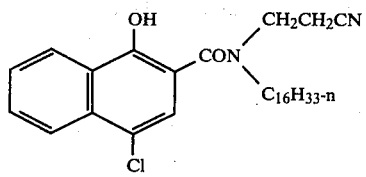

and 67 g of gelatin at 40° C. to form a solution. To the solution were added 4-hydroxy-6-methyl-1,3,3a,7-tetrazaindene (0.8 g) as a stabilizer and 1.5 g of dichlorohydroxytriazine sodium salt as a hardener. The resulting coating composition was coated on both surfaces of a polyethylene terephthalate support in equal amounts (the total coated area amounted to 30 $m^2$) and dried.

A gelatin layer having a thickness of about 0.015 mm was coated on the resulting gelatin/silver halide emulsion layer, and dried to form a photographic material.

The photographic material obtained was cut into six strips, and the strips were each exposed (tungsten lamp (2854° K.)) through an optical wedge under the same conditions and then processed with a developer of the following formulation at 35° C. for 50 seconds.

| Developer | | |
|---|---|---|
| N-hydroxyethyl-N-ethyl-p-phenylenediamine | 12 | g |
| Benzyl alcohol | 10 | g |
| Anhydrous sodium sulfite | 4 | g |
| Potassium bromide | 2 | g |
| 5-Nitroisoindazole | 0.05 | g |
| Sodium carbonate | 25 | g |
| pH (adjusted with NaOH) | 10.5 | |
| Water to make | 1 | l |

The strips so developed were then treated with a fixing bath of the following formulation at 35° C. for 50 seconds, and then rinsed.

| Fixing bath | |
|---|---|
| Anhydrous sodium thiosulfate | 150 g |
| Anhydrous sodium sulfite | 15 g |
| pH (adjusted with acetic acid) | shown in Table 1 |
| Water to make | 1 l |

A blue image was obtained by the above processing steps. The blue image was tested by means of a color densitometer equipped with a red filter. The results are shown in Table 1. The absorption peak of the color image was 630 mμ.

The relative sensitivity in Table 1 is expressed as a log E value at a density of fog+0.5. The speed obtained when processing the sample with a fixing bath having the above composition except for having a pH of 4.0 was specified as 100. The contrast is the gradient of the characterisitc curve between a density of 0.25 and a density of 2.00. $D_{max}$ is the maximum density of the image.

TABLE 1

| | pH of the Fixing Bath | Fog | Relative Speed | Contrast (gradation) | $D_{max}$ |
|---|---|---|---|---|---|
| 1 | 4.0 | 0.04 | 100 | 2.16 | 2.8 |
| 2 | 5.0 | 0.04 | 100 | 2.16 | 2.8 |
| 3 | 6.0 | 0.04 | 115 | 2.50 | 3.1 |
| 4 | 7.0 | 0.04 | 118 | 2.70 | 3.6 |
| 5 | 8.0 | 0.05 | 120 | 2.98 | 3.8 |
| 6 | 9.0 | 0.07 | 120 | 2.98 | 3.8 |

It can be seen from the results shown in Table 1 that with increasing the pH of the fixing bath, the speed, contrast and $D_{max}$ increased, and at a pH of at least 8, there is no appreciable change in these properties. This shows that fixing at high pH values gives better images. It is also seen from Table 1 that the reduction of density with time is remarkable with fixing baths having a pH as low as 4.0 to 5.0, but there is scarcely any reduction in density with time in the case of fixing baths having a high pH value.

EXAMPLE 2

Photographic materials were prepared in the same way as in Example 1 except that the amount of the optional hardener was changed as indicated in Table 2. The relationship between the amount of the hardener, the swelling factor of the photographic material at the time of rinsing and the finished condition of the photographic material upon processing in an automatic processor are shown in Table 2.

TABLE 2

| | Amount (g) | Swelling Factor | Finished Condition |
|---|---|---|---|
| 1 | 0.6 | 9 | Wetted and the finish was incomplete; the surface was replete with scratches |
| 2 | 1.0 | 8 | Dry, but injuries were liable to be caused by processor rollers |
| 3 | 1.5 | 5 | Good |

The swelling factor of the photographic material was determined as follows:

The photographic material was processed with the developer and the fixing bath shown in Example 1 each at 35° C. for 50 seconds, and then rinsed for 50 seconds with water at 35° C. The value obtained by dividing the thickness of the coating of the photographic material so rinsed by the thickness of the dry coating before processing is defined as the swelling factor.

The finished condition of the photographic material was determined as follows:

The photographic material shown in Example 1 was processed for 50 seconds using 3.5 Minute Processing Processor RN (an automatic processor for black-and-white radiographic materials made by Fuji Photo Film Co., Ltd.). The warm air used in the drying step was maintained at 50° C. The finished condition of the processed photographic material was visually evaluated.

When the swelling factor is not more than 8, preferably not more than 5, good finish can be obtained, as shown in Table 2.

Since the fixing bath does not contain a hardener such as aluminum alum, the recovery of silver from the used fixing solution is greatly simplified.

While the invention has been described in detail and with reference to specific embodiments thereof, it will be apparent to one skilled in the art that various changes and modifications can be made therein without departing from the spirit and scope thereof.

What is claimed is:

1. A process for forming color images, which comprises image-wise exposing a silver halide color radiographic material comprising a support and at least one silver halide emulsion layer, developing the thus image-wise exposed material with a color developer in the presence of a color coupler, and thereafter fixing the developed material with a separate fixing bath having a pH of at least 6 but no greater than about 12, which fixing bath is free of hardening agent, the process being free from a silver bleaching step and including a rinsing after said fixing, wherein the silver halide color radiographic material has been hardened so that the thickness of its coating at the end of the rinsing is not more than 8 times the thickness of the coating in dry form before processing, wherein said color coupler forms a quinone amide dye having a minimum absorption in the spectral wave length region of about 550 to about 700 mμ upon development, said color coupler has the formula:

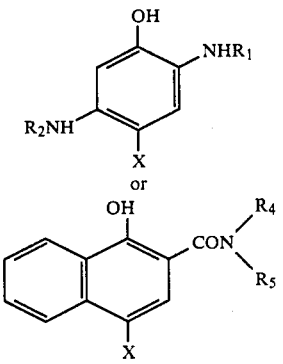

wherein $R_1$ and $R_2$ represent an acyl group derived from substituted or unsubstituted aliphatic carboxylic acids containing 2 to 25 carbon atoms, an acyl group derived from substituted or unsubstituted aromatic carboxylic acids containing 7 to 30 carbon atoms, an acyl group derived from substituted or unsubstituted heterocyclic carboxylic acids containing 1 to 5 nitrogen, oxygen or sulfur atoms either alone or in combination and 2 to 25 carbon atoms, an acyl group derived from substituted or unsubstituted aliphatic sulfonic acids containing 1 to 25 carbon atoms, an acyl group derived from substituted or unsubstituted aromatic sulfonic acids containing 6 to 30 carbon atoms, a sulfonylthienyl group, or an acyl group derived from aryloxy substituted aliphatic carboxylic acids containing 7 to 30 carbon atoms which can be substituted or unsubstituted; $R_4$ and $R_5$ represent a hydrogen atom, a substituted or unsubstituted aryl group containing 6 to 30 carbon atoms, or a substituted or unsubstituted alkyl group containing 1 to 25 carbon atoms; and X represents a substituent which can be split off upon coupling with a developing agent, wherein the steps of developing, fixing and rinsing are carried out within 3.5 minutes.

2. The process of claim 1, wherein the color developer contains a phenylenediamine as a color developing agent.

3. The process of claim 1, wherein said fixing bath has a pH of no greater than 10.5.

4. The process of claim 1, wherein said fixing bath contains thiosulfate as a fixing agent.

5. The process of claim 3, wherein said fixing agent is selected from the group consisting of sodium thiosulfate, ammonium thiosulfate, potassium cyanate, ammonium thiocyanate, thiourea and sodium sulfite.

6. The process of claim 4, wherein said fixing agent is sodium thiosulfate and said fixing bath has a pH of from 6 to about 11.

7. The process of claim 1, wherein said fixing is with a fixing bath free of alum and wherein the fixing bath contains, as a fixing agent, a member selected from the group consisting of sodium thiosulfate, ammonium thiosulfate, potassium cyanate, ammonium thiocyanate, thiourea and sodium sulfite.

8. The process of claim 1, wherein the fixing is with a fixing bath free of alum and wherein the fixing bath contains as a fixing agent a member selected from the group consisting of sodium thiosulfate, ammonium thiosulfate, potassium cyanate, ammonium thiocyanate, thiourea and sodium sulfite, and wherein the steps of developing, fixing and rinsing are carried out within 3.5 minutes.

9. The process of claim 1, wherein said fixing bath is free of alum.

10. In a photographic process for forming color images which is carried out within 3.5 minutes in a photographic processor having rollers for photographic material transport, which comprises image-wise exposing a silver halide color radiographic material comprising a support and at least one silver halide emulsion layer, developing the thus image-wise exposed material with a color developer in the presence of a color coupler, and thereafter fixing the developed material with a separate fixing bath, the process being free from a silver bleaching step and including a rinsing after said fixing, wherein said color coupler forms a quinone amide dye having a maximum absorption in the spectral wave length of about 550 to about 700 mμ upon development, said color coupler has the formula:

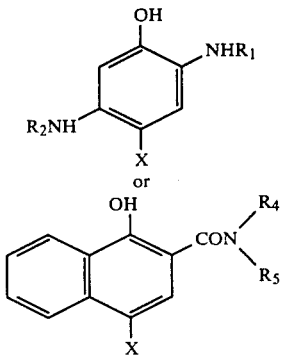

wherein $R_1$ and $R_2$ represent an acyl group derived from substituted or unsubstituted aliphatic carboxylic acids containing 2 to 25 carbon atoms, an acyl group derived from substituted or unsubstituted aromatic carboxylic acids containing 7 to 30 carbon atoms, an acyl group derived from substituted or unsubstituted heterocyclic carboxylic acids containing 1 to 5 nitrogen, oxygen or sulfur atoms either alone or in combination and 2 to 25 carbon atoms, an acyl group derived from substituted or unsubstituted aliphatic sulfonic acids containing 1 to 25 carbon atoms, an acyl group derived from substituted or unsubstituted aromatic sulfonic acids containing 6 to 30 carbon atoms, a sulfonylthienyl group, or an acyl group derived from aryloxy substituted aliphatic carboxylic acids containing 7 to 30 carbon atoms which can be substituted or unsubstituted; $R_4$ and $R_5$ represent a hydrogen atom, a substituted or unsubstituted aryl group containing 6 to 30 carbon atoms, or a substituted or unsubstituted alkyl group containing 1 to 25 carbon atoms; and X represents a substituent which can be split off upon coupling with a developing agent, the improvement which comprises said silver halide emulsion layer having been hardened so that the thickness of its coating at the end of the rinsing is not more than 8 times the thickness of the coating in dry form before processing, said fixing bath having a pH of at least 6 but no greater than about 12, and said fixing bath contains no hardening agent.

11. The process of claim 1, wherein said silver halide emulsion layer contains a hardening agent added thereto during forming said color radiographic material.

12. The process of claim 11, wherein said silver halide emulsion layer contains a hydrophilic colloid binder, and said hardener is used in an amount of about 0.003 to about 3 g/g of said hydrophilic colloid binder.

13. The process of claim 12, wherein said hardener is dichlorohydroxytriazine sodium salt.

14. The process of claim 10, wherein said silver halide emulsion layer contains a hardening agent added thereto during forming said color radiographic material.

15. The process of claim 10, wherein said silver halide emulsion layer contains a hydrophilic colloid binder, and said hardener is used in an amount of about 0.003 to about 3 g/g of said hydrophilic colloid binder.

16. The process of claim 15, wherein said hardener is dichlorohydroxytriazine sodium salt.

17. The process of claim 16, wherein said fixing bath contains thiosulfate as a fixing agent.

18. The process of claim 17, wherein said fixing agent is sodium thiosulfate.

19. The process of claim 1, wherein the color developer further comprises an aromatic primary amine.

20. The process of claim 10, wherein the color developer further comprises an aromatic primary amine.

21. The process of claim 1, wherein said thickness at the end of rinsing is not more than five times the thickness of the coating in dry form before processing.

22. The process of claim 10, wherein said thickness at the end of rinsing is not more than five times the thickness of the coating in dry form before processing.

* * * * *

UNITED STATES PATENT AND TRADEMARK OFFICE

CERTIFICATE OF CORRECTION

PATENT NO. : 4,222,777

DATED : September 16, 1980

INVENTOR(S) : Yosuke Nakajima et al

It is certified that error appears in the above—identified patent and that said Letters Patent is hereby corrected as shown below:

In the Heading, at line [63], delete "February 21, 1976" and insert therefor -- February 27, 1976 --.

Signed and Sealed this

*Third* Day of *February 1981*

[SEAL]

*Attest:*

RENE D. TEGTMEYER

*Attesting Officer*

*Acting Commissioner of Patents and Trademarks*